US008387637B2

(12) United States Patent
Witkowski

(10) Patent No.: US 8,387,637 B2
(45) Date of Patent: Mar. 5, 2013

(54) UMBRELLA OR PARASOL SYSTEM

(76) Inventor: Andrej Witkowski, Hagersten (SE)

( * ) Notice: Subject to any disclaimer, the term of this patent is extended or adjusted under 35 U.S.C. 154(b) by 0 days.

(21) Appl. No.: 12/446,197

(22) PCT Filed: Dec. 27, 2007

(86) PCT No.: PCT/SE2007/001173

§ 371 (c)(1),
(2), (4) Date: Oct. 4, 2010

(87) PCT Pub. No.: WO2008/082342

PCT Pub. Date: Jul. 10, 2008

(65) Prior Publication Data

US 2011/0017248 A1 Jan. 27, 2011

(30) Foreign Application Priority Data

Dec. 29, 2006 (SE) ..... 0602846
Apr. 13, 2007 (SE) ..... 0700867

(51) Int. Cl.
*A45B 23/00* (2006.01)

(52) U.S. Cl. ..... 135/20.1; 135/24

(58) Field of Classification Search ..... 135/20.1, 135/24, 27

See application file for complete search history.

(56) References Cited

U.S. PATENT DOCUMENTS

| | | | | |
|---|---|---|---|---|
| 256,308 | A * | 4/1882 | Forster | 135/20.1 |
| 779,241 | A * | 1/1905 | Schuller | 135/20.1 |
| 990,632 | A * | 4/1911 | Burton | 135/20.1 |
| 1,093,160 | A * | 4/1914 | Wagner | 135/20.1 |
| 3,464,431 | A | 9/1969 | Loeffler | |
| 3,533,423 | A * | 10/1970 | Estell | 135/20.1 |
| 4,274,429 | A | 6/1981 | Kinski | |
| 4,606,366 | A * | 8/1986 | Collet | 135/20.1 |
| 4,736,761 | A | 4/1988 | Warfield et al. | |
| 5,002,080 | A * | 3/1991 | Ma | 135/20.1 |
| 5,263,505 | A * | 11/1993 | Yeom | 135/20.1 |
| 5,483,985 | A | 1/1996 | Yu | |
| 5,927,310 | A * | 7/1999 | Lin | 135/20.1 |
| 5,960,806 | A * | 10/1999 | Steiner | 135/20.1 |
| 6,070,602 | A | 6/2000 | Ling Kuo | |
| 6,910,490 | B1 * | 6/2005 | Villa | 135/20.1 |
| 7,121,289 | B1 | 10/2006 | Anderson | |
| 2011/0000513 | A1 * | 1/2011 | Amron et al. | 135/27 |

FOREIGN PATENT DOCUMENTS

| | | |
|---|---|---|
| DE | 580503 C | 7/1933 |
| DE | 29700306 | 5/1997 |
| FR | 2609607 A1 | 7/1988 |
| GB | 2200044 | 7/1988 |

OTHER PUBLICATIONS

International Bureau Notification Concerning Transmittal of International Preliminary Report on Patentability (Chapter I of the Patent Cooperation Treaty) Jul. 9, 2009.
Supplementary European Search Report mailed Apr. 8, 2010.

* cited by examiner

*Primary Examiner* — Noah Chandler Hawk
(74) *Attorney, Agent, or Firm* — Holland & Hart LLP

(57) ABSTRACT

The present invention relates to an umbrella or parasol system that has two shafts for connecting multiple umbrellas or parasols. The system further has opening springs in the upper parts of the shafts, which together with a support arrangement in the lower parts of the shafts, are arranged to open stretchers of the system.

13 Claims, 8 Drawing Sheets

UMBRELLA OR PARASOL SYSTEM

FIELD OF THE INVENTION

The present invention relates to umbrellas or parasols in general. The present invention relates in particular to an umbrella or parasol system.

BACKGROUND AND SUMMARY OF THE INVENTION

Umbrellas or parasols comprising multiple ribs, hereinafter referred to as umbrella or parasol systems, can be used in order to readily provide a large canopy surface by combining two conventional umbrellas or parasols to form an umbrella or parasol system. It is difficult, however, to produce reasonable opening- and closing mechanisms for such systems. Conventional umbrellas are furthermore usually intended to be carried in one hand and in the opened state these have a spherically round shape to their canopy. In windy weather such umbrellas sometimes impose considerable stresses on a user's wrist and moreover afford inadequate protection from wind and rain.

An object of the present invention is therefore to provide an umbrella or parasol system which easily affords a large canopy surface.

The special characteristics of an umbrella or parasol system according to the present invention are set forth in Claim 1.

The use of a first opening spring fixed to the top of a first shaft and a second opening spring fixed to the top of a second shaft, the two opening springs each pressing stretchers down towards a common grip, provides an umbrella or parasol system which is strong and stable, which opens and closes easily, and which offers scope for many practical forms of canopy. In the closed state the umbrella system has a handle which is comfortable to carry in one hand. In the opened state the umbrella system has a handle which affords a good grip for more than one hand, from one or two people, and which offers scope for firm support against the user's body. The two shafts provide an umbrella or parasol system which affords an extensive canopy with a large and stable surface.

The first and second shafts are advantageously arranged parallel to one another both when the umbrella is opened and when it is closed, which creates a frame that gives the umbrella or parasol system stability.

For flexible opening of the umbrella or parasol system, the first shaft and the second shaft are advantageously joined by an articulated connection to the common grip. The grip advantageously comprises a middle part which is designed to be moved upwards and downwards in relation to the shafts when opening and closing the umbrella or parasol system.

The position of the opening springs in the upper part of the shafts and the way of opening the umbrella system by pressing each of the stretchers down means that there is plenty of space for fixing a simple umbrella holder in the umbrella system on both shafts, without getting on the way of the stretchers. This represents a simple way of providing a hands-free umbrella.

In a parasol system the first and the second connection advantageously comprise a line, a string or a cord. In an umbrella system the first and the second connection advantageously comprise an articulated connection.

Further characteristics and advantages of the present invention will be set forth in the following description and the succeeding patent claims.

The invention will be described in more detail below with reference to the detailed description of embodiments and the drawings attached, which are merely illustrative of the present invention and therefore do not limit the present invention.

DETAILED DESCRIPTION OF EMBODIMENTS

Figure 1:
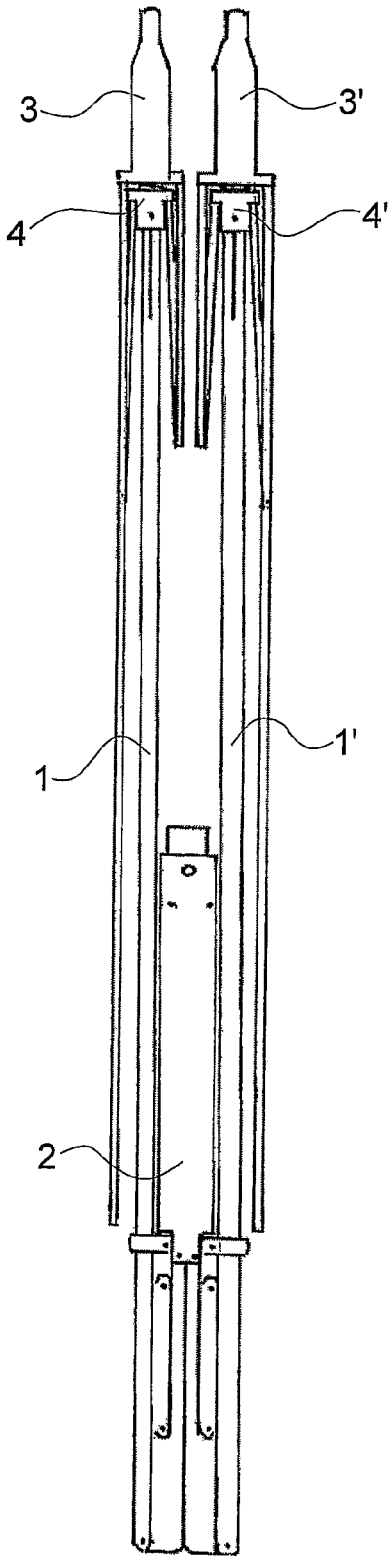
FIG. 1 shows an umbrella system according to a first embodiment of the present invention in the folded state, illustrated without the canopy.
Figure 3:
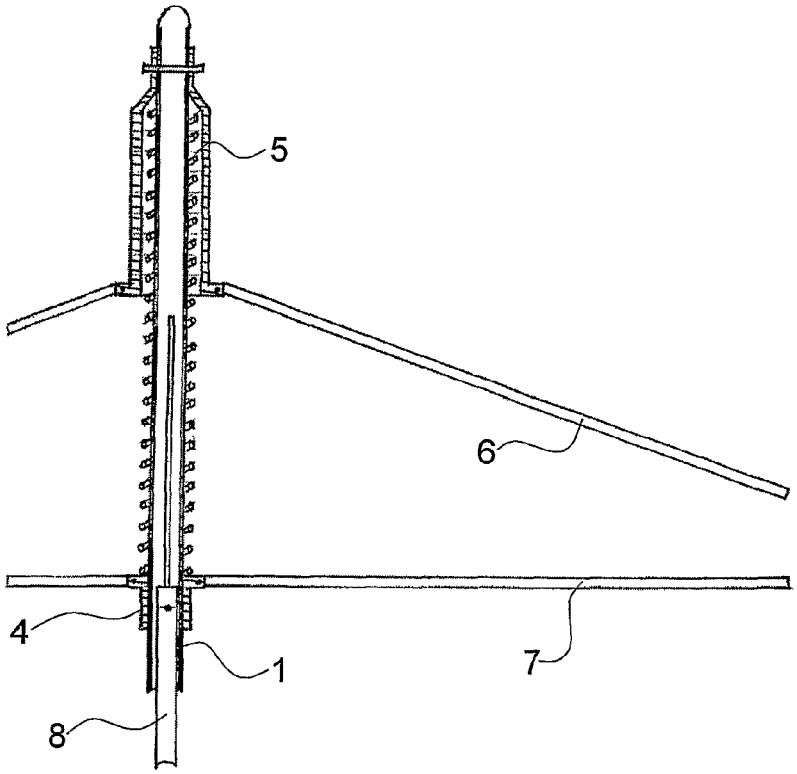
FIG. 3 shows the upper part of the umbrella system shown in FIG. 2 in the opened state.
Figure 2:
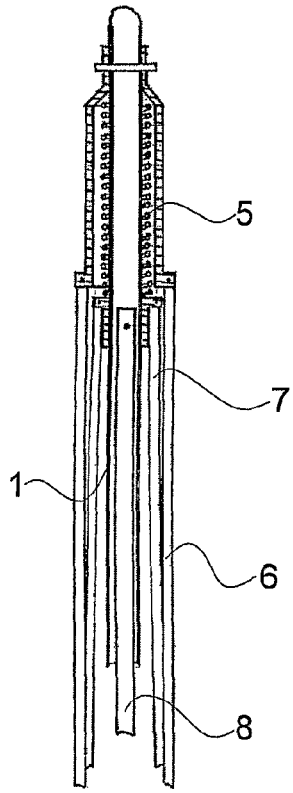
FIG. 2 shows an enlargement of the upper part of a shaft of the umbrella system shown in FIG. 1.
Figure 4:
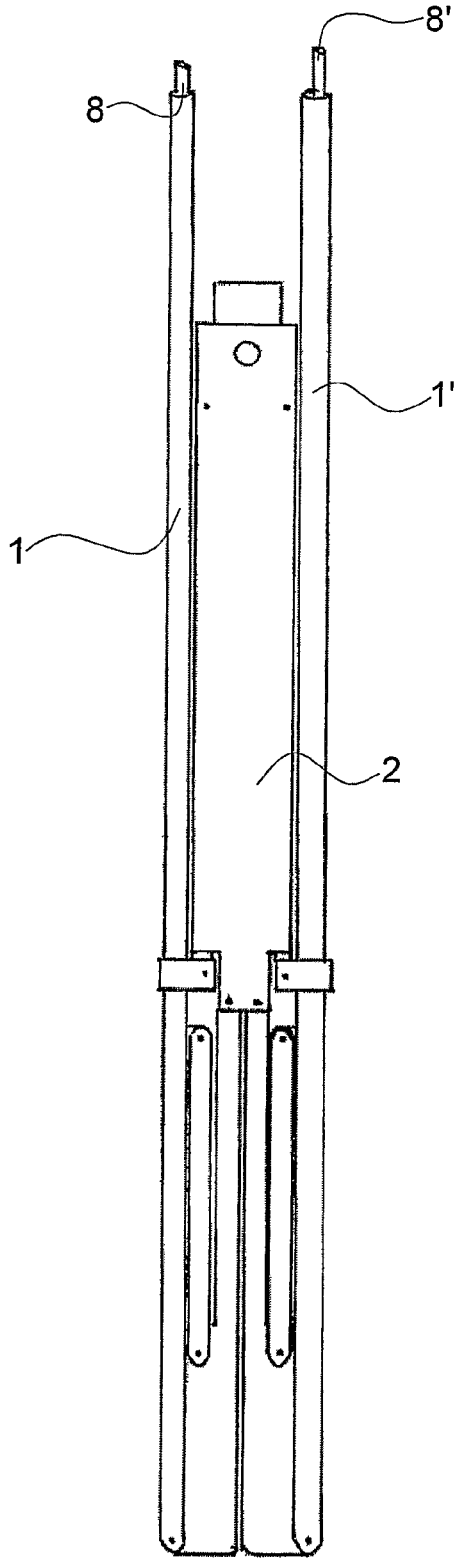
FIG. 4 shows an enlargement of the lower part of the umbrella system shown in FIG. 1.
Figure 5:
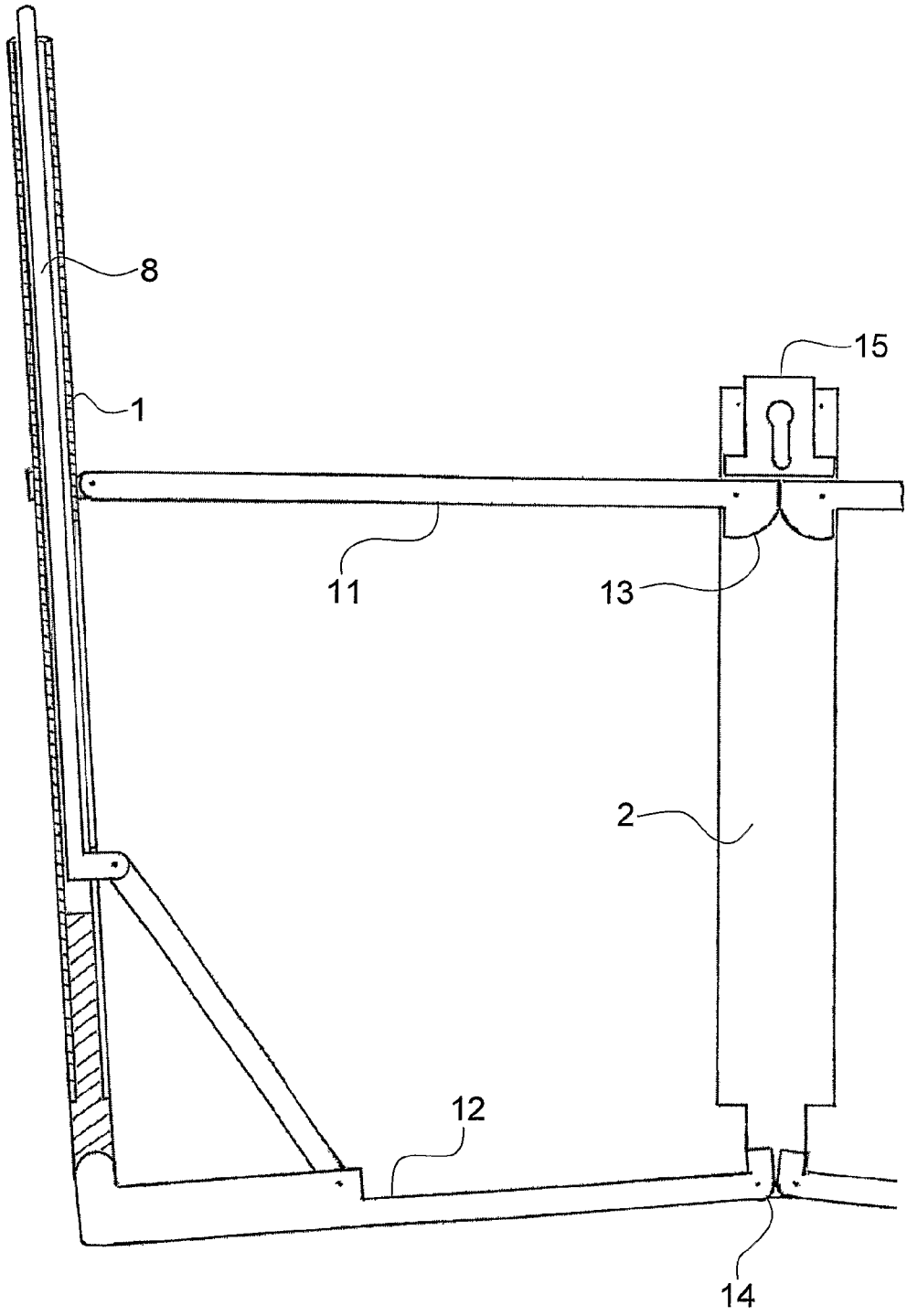
FIG. 5 shows a portion of the lower part of the umbrella system shown in FIG. 4 in the opened state.

The following description is intended to explain and not to limit specific details, such as particular techniques and applications, in order to furnish a fundamental understanding of the present invention. It will be obvious to a person skilled in the art, however, that the present invention can be implemented in other embodiments that differ in these specific details. In other examples a detailed description of well-known methods and arrangements is omitted, in order not to obscure the description of the present invention with unnecessary details.

A first embodiment of the invention will now be described with reference to FIGS. 1 to 5.

In the drawings an umbrella system is illustrated without the canopy in order to provide a clear view of other parts. The umbrella system comprises a first shaft 1 and a second shaft 1', in order to provide a so-called twin umbrella. The umbrella system comprises a first upper part 3 firmly affixed to the first shaft 1 and a second upper part 3' firmly affixed to the second shaft 3', and a common grip or handle 2. The umbrella system further comprises a first runner 4 slidably fastened to the first shaft 1 and coupled by a first articulated connection 8 to the grip 2, and a second runner 4', slidably fastened to the second shaft 1' and coupled by a second articulated connection 8' to the grip 2. The shafts are advantageously substantially parallel to one another, both with the umbrella system opened, with the umbrella system closed and during opening and closing of the umbrella system, in order to give the umbrella system good stability. With the umbrella system opened, the grip 2 has an open position which allows it to be grasped by more than one hand and affords good support against the body of a user. With the umbrella system closed, the grip 2 has a closed position which allows it to be carried comfortably in one hand.

Only one shaft with the respective parts will now be described, since the umbrella system is symmetrical.

On the shaft 1 is an opening spring 5, arranged in the upper part of shaft 1 opposite the runner 4, which is coupled to the grip 2 by the articulated connection 8. The grip 2 is arranged in the lower part of the shaft 1. The grip 2 is a handle in the case of a portable umbrella system, for example, and an anchoring arrangement in that of a parasol system. The opening spring 5 in a folded umbrella system is compressed so that by pressing in a release button, for example, the opening spring 5 presses the runner 4 down together with one or more stretchers 7, and by way of the articulated connection 8 also presses the grip 2 down, which opens up the umbrella system by opening a plurality of ribs 6, which raise a canopy or fabric and at the same time opens the handle arrangement or the grip 2. The use of the opening spring 5 fixed to the top of the umbrella system means that the runner 4 with the stretcher 7 will only slide a short distance on the shaft 1.

The lower part of the shaft is advantageously joined by an articulated connection to the grip 2, so that the shafts are kept substantially parallel to one another. An elongated grip 2 comprising two substantially parallel articulated connections 11 and 12 to the shaft 1 affords several advantages. When the umbrella system is opened, and the grip 2 is thereby also in an opened position, it can be grasped in three different ways. A person can then carry the umbrella system by grasping the grip 2 with one hand or, in a strong wind, for example, by keeping a hand on each shaft 1 and 1' between the parallel articulated connections. Two persons can walk together under the umbrella system, each grasping a shaft. The substantially parallel articulated connections 11 and 12 and the shafts 1 and 1' furthermore make up a frame which gives the open umbrella system good stability. In order to ensure simultaneous opening of both sides of the grip 2, they advantageously interact through a toothed engagement 13 or 14, or a toothed engagement 13 and 14. The four points at which the grip 2 supports the shafts 1 and 1' are what give the umbrella system the aforementioned stability.

In order to ensure that the umbrella system is not accidentally closed, it advantageously comprises a locking catch 15 in the opened position. In order to close the umbrella system, the locking catch 15 must then first be released before the grip is folded up, so that the shafts 1 and 1' are moved up to one another in a parallel position. The middle part of the grip 2 is moved upwards in relation to the shafts 1 and 1', which causes the articulated connections 8 and 8' to push the runners 4 and 4' up. In opening the umbrella system the movements occur in the reverse direction.

Figure 6:
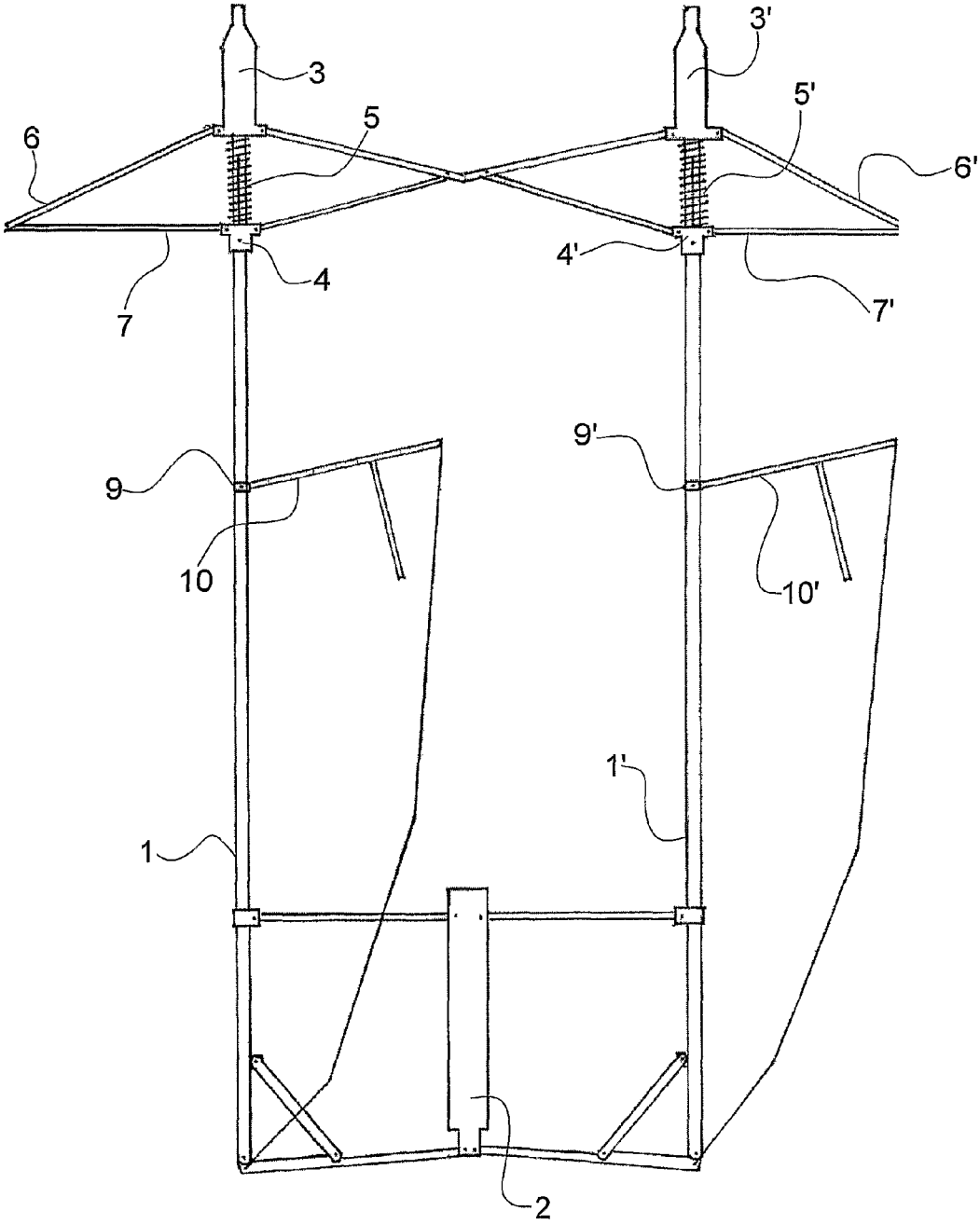
FIG. 6 shows an umbrella system according to a second embodiment of the present invention in the opened state.

A second embodiment of the present invention will next be described with reference to FIG. 6. This embodiment is identical to the preferred embodiment described above, save for the following.

Because the opening springs 5 and 5' press the runners 4 and 4' down together with the stretchers 7 and 7', only a small part of the shafts 1 and 1' is used for opening of the plurality of ribs 6 and 6', which raise the canopy or the fabric.

The umbrella system comprises an umbrella grip 9, 9' fixed, advantageously firmly affixed, to each shaft 1, 1'. Fixed to these umbrella grips 9, 9', for example, are distance pieces 10, 10', which keep the umbrella system at just the right distance from the person carrying the umbrella. These distance pieces are then advantageously connected by ties, which run over the shoulders and down the back of the user and to the lower parts of the shafts 1, 1'.

Figure 7:
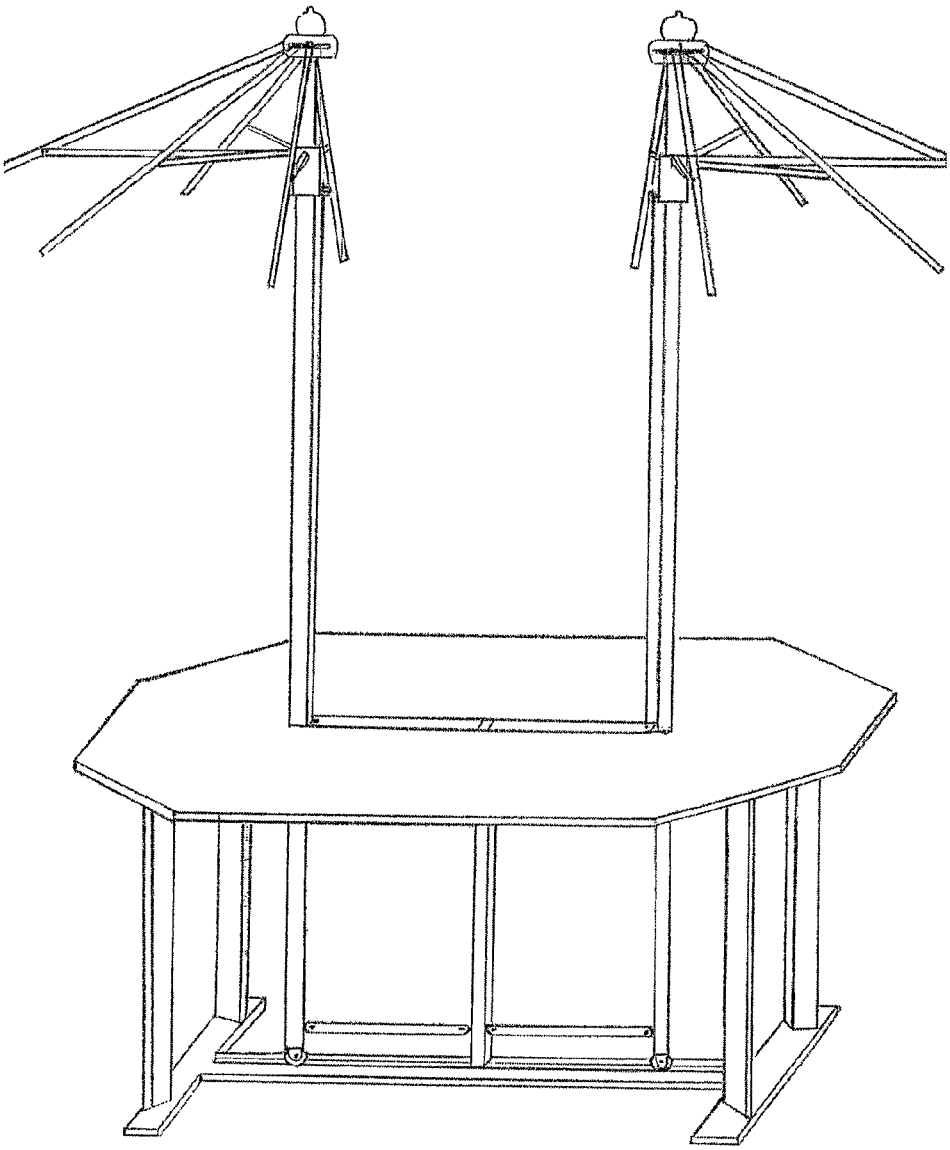
FIG. 7 shows a parasol system according to a third embodiment of the present invention in the opened state, illustrated without the canopy.

A third embodiment of the present invention will next be described with reference to FIG. 7. This embodiment relates to a parasol system which is identical to the first embodiment described above, save for the following.

A parasol system normally has stronger and therefore heavier ribs and canopy than an umbrella system, so that in closing the parasol system the intrinsic weight of the canopy and ribs can be utilized in order to press the grip together. As a result, the connection between the stretchers and the grip does not need to be capable of acting in both directions, and can thereby be embodied by a line, a string or a cord, for example. In opening the parasol system, the shafts are drawn apart and an opening string fixed to the stretchers and the grip thereby draws the stretchers down, so that the canopy is deployed. Since a parasol system is not normally hand-held, the lines can run outside the shafts rather than inside the shafts as in an umbrella system.

The parasol system can easily be positioned in a table with an elongated notch, which allows an oblong canopy to stably cover an oblong table. In the opened state the shafts are wide apart, and in the closed state they are positioned up against one another, which means that parasol system takes up little space. An added advantage in opening/closing the canopy from above/from below is that the risk of jamming is reduced, since the runners move upwards instead of downwards when closing.

The parasol system is here shown with wheels, which run in an elongated rail for easier opening and closing of the parasol system.

In all the embodiments the grip can be positioned at different levels on the shafts, provided that it is below the lowest level for the runners. In an umbrella system there is an added advantage in locating it at the very bottom, in that it can then be used as a handle in a number of ways as described above. In a parasol system there is an added advantage in locating it at the very bottom, in that it is out of sight under a table which is situated in or under a balcony parapet against which the table is placed, or in placing it right at the top if it us used as a beach parasol or party gazebo, in order to expose the ground surface.

The parasol system can easily be expanded to include three or more parallel shafts coupled crosswise in a Y shape or coupled in series one after another.

Figure 8:
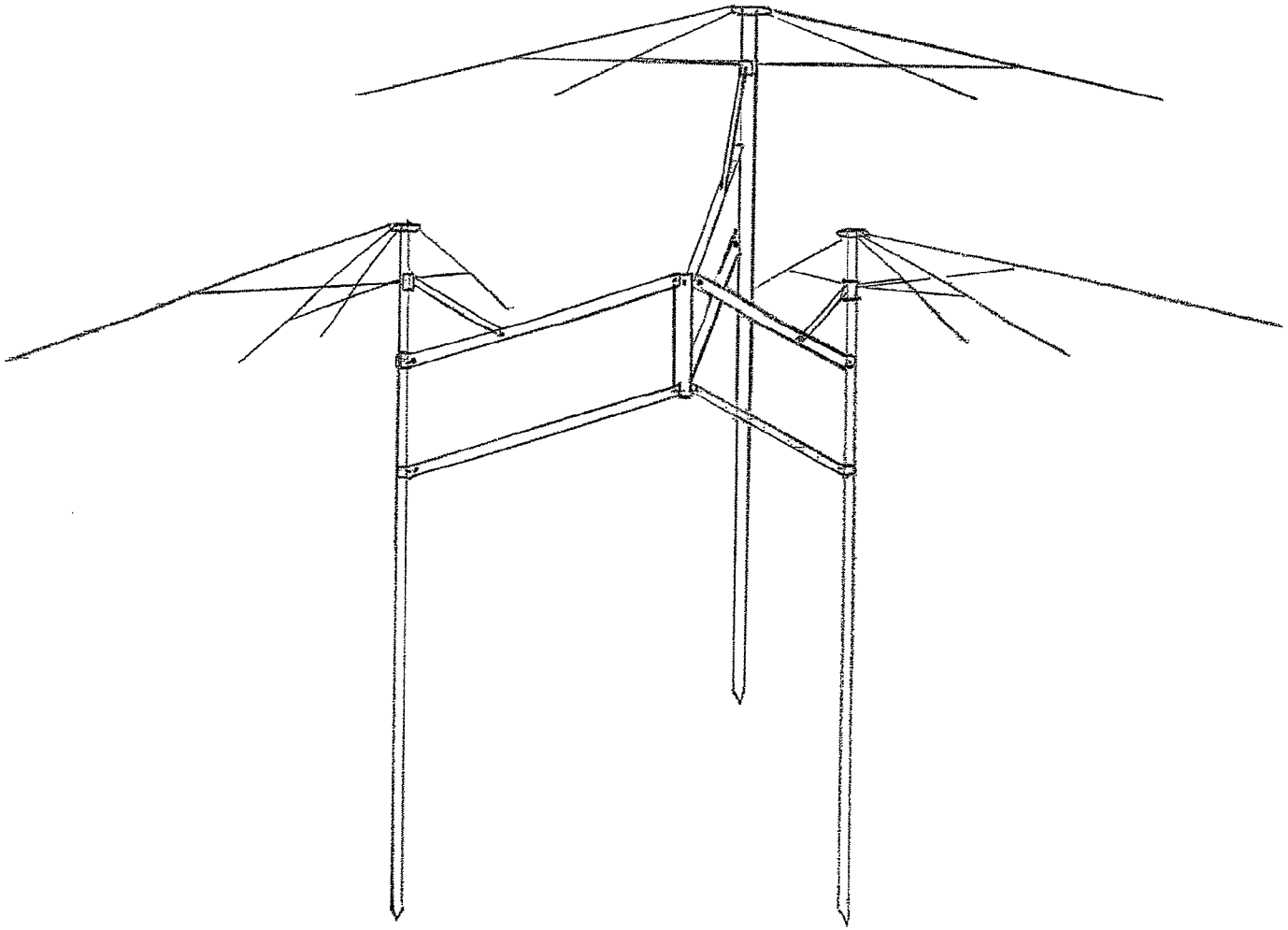
FIG. 8 shows a variant of a parasol system according to the third embodiment of the present invention in the opened state, illustrated without the canopy, suitably as a beach parasol.

A parasol system suitable for use as a beach parasol or party gazebo is illustrated in FIG. 8, in which three parallel shafts are coupled crosswise and in which the grip is positioned high up on the shafts. A toothed engagement between the three sides in the grip can advantageously interact with a common toothed rack.

Figure 9:
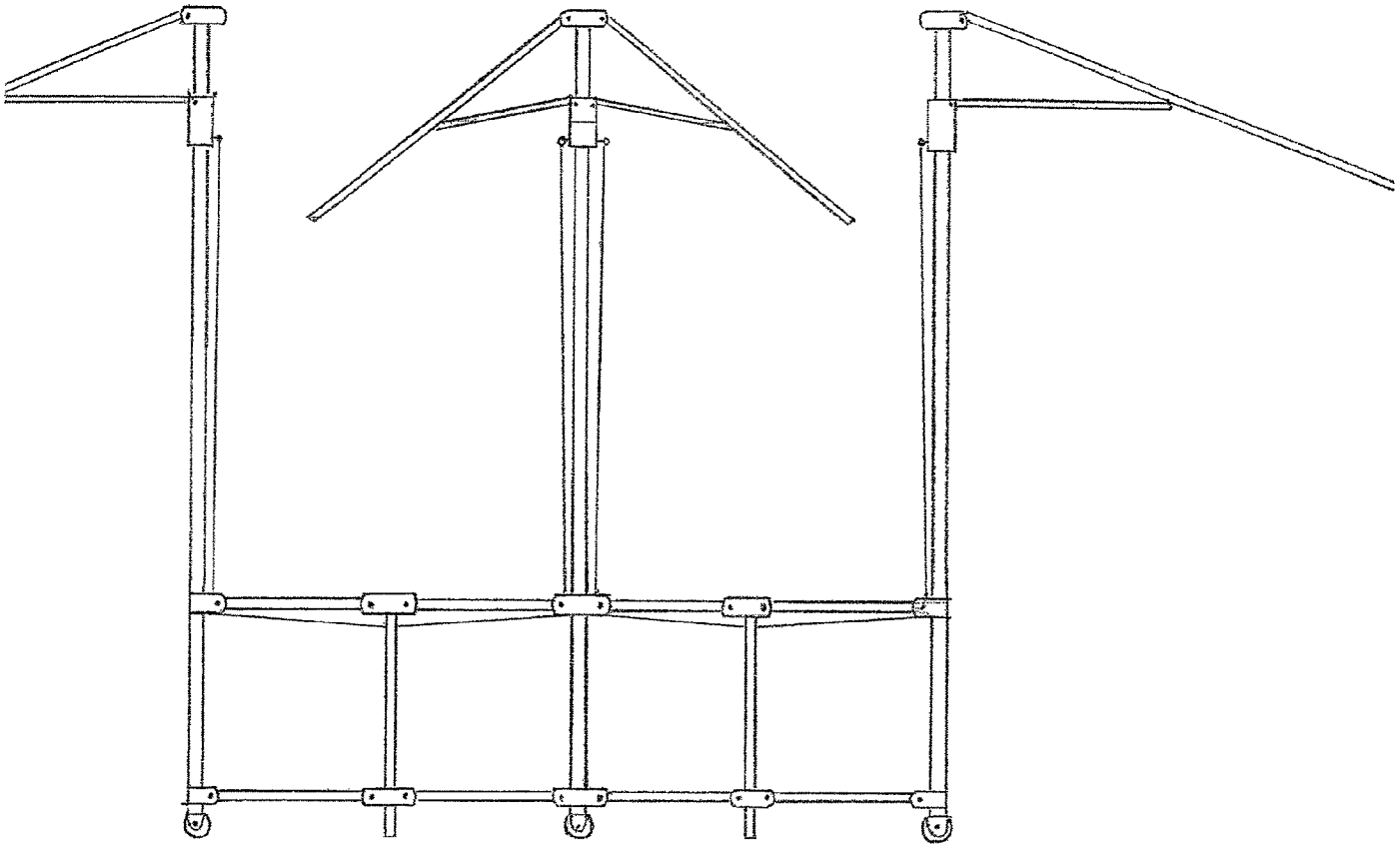
FIG. 9 shows a variant of a parasol system according to the third embodiment of the present invention in the opened state, illustrated without the canopy, suitably as a table parasol.

A parasol system suitable for use as a table parasol or patio parasol is illustrated in FIG. 9, in which three parallel shafts have been coupled in series. A toothed engagement can here also be used at the middle shaft, in order to couple the entire system together to form a directly interacting system.

The present invention can obviously be modified in a number of ways. Such modifications must not be regarded as departing from the scope of the present invention. All such modifications that would be obvious to a person skilled in the art are deemed to be included within the scope of the present invention.

The invention claimed is:

1. An umbrella or parasol system comprising:

a grip;

a first shaft having a first end and a second end located opposite the first end, the first shaft being connected to the grip at the first end of the first shaft via a first articulated connector and having a first opening spring permanently connected to the second end of the first shaft;

a first runner slidably connected to the first shaft and having an upper surface that engages with the first opening spring and being operatively connected to the first articulated connector via a third articulated connector; and a second shaft having a first end and a second end located opposite the first end, the second shaft being connected to the grip at the first end of second shaft via a second articulated connector and having a second opening spring permanently connected to second end of the second shaft;

a second runner slidably connected to the second shaft and having an upper surface that engages with the second opening spring and being operatively connected to the second articulated connector via a fourth articulated connector;

wherein the first shaft and the second shaft are aligned substantially parallel to one another in both an open and a closed position and remain aligned substantially parallel to one another during transition between the open position and the closed position.

2. The umbrella or parasol system of claim 1, wherein the first runner is proximate the second end of the first shaft when the umbrella or parasol system is in the dosed position and wherein the second runner is proximate the second end of the second shaft when the umbrella, or parasol system is in the closed position.

3. The umbrella or parasol system of claim 1, wherein the first articulated connector and the second articulated connector are located under the grip when the umbrella or parasol system is in the closed position.

4. The umbrella or parasol system of claim 1, wherein the third articulated connector is disposed inside of the first shaft and the fourth articulated connector is disposed inside of the second shaft.

5. The umbrella or parasol system of claim 1, further comprising:

one or more first ribs extending from a location proximate the second end of the first shaft; and one or more second ribs extending from a location proximate the second end of the second shaft.

6. The umbrella or parasol system of claim 5, further comprising:

a first canopy supported by the one or more first ribs; and a second canopy supported by the one or more second ribs.

7. An umbrella or parasol system comprising:

a grip;

a first shaft having a first end and a second end located opposite the first end, the first shaft being connected to the grip at the first end of the first shaft via a first articulated connector and having a first opening spring permanently connected to the second end of the first shaft;

a first runner slidably connected to the first shaft and having an upper surface that engages with the first opening spring; and a second shaft having a first end and a second end located opposite of the first end, the second shaft being connected to the grip at the first end of second shaft via a second articulated connector and having a second opening spring permanently connected to second end of the second shaft;

a second runner slidably connected to the second shaft and having an upper surface that engages with the second opening spring;

wherein the first shaft and the second shaft are aligned substantially parallel to one another in both an open and a closed position and remain aligned substantially parallel to one another during transition between the open position and the closed position and wherein the first articulated connector includes a toothed engagement, the second articulated connector includes a toothed engagement, and the first toothed engagement engages with the second tooth engagement.

8. An umbrella or parasol system having an open configuration and a closed configuration, wherein the system comprises:

a grip;

a first articulated connector operatively connected to the grip and a second articulated connector operatively connected to the grip;

a first shaft operatively connected to the first articulated connector at a first end of the shaft and a second shaft operatively connected to the second articulated connector at a first end of the shaft;

a third articulated connector operatively connected to the first articulated connector and disposed within the first shaft and a fourth articulated connector operatively connected to the second articulated connector and disposed within the second shaft;

a first runner slidably connected to the first shaft and operatively connected to the third articulated connector and a second runner slidably connected to the second shaft and operatively connected to the fourth articulated connector;

one or more first stretchers operatively connected to the first runner and one or more second stretchers operatively connected to the second runner;

a first opening spring permanently connected to the first shaft at a second end of the first shaft and a second opening spring permanently connected to the first shaft at a second end of the second shaft;

one or more first ribs, each of which is operatively connected at a first end to the second end of the first shaft and, operatively connected at a second end to one of the one or more first stretchers;

one or more second ribs, each of which is operatively connected at a first end to the second end of the second shaft and operatively connected at a second end to one of the one or more second stretchers; and a first canopy supported by the one or more first ribs and a second canopy supported by the one or more second ribs.

9. The umbrella or parasol system of claim 8, wherein when the system is in an open position:

the first runner is located away from the second end of the first shaft and the second runner is located away from the second end of the second shaft;

the first shaft is parallel to the second shaft; and the first articulated connector and the second articulated connector are located lateral to the grip.

10. The umbrella or parasol system of claim 9, wherein the first articulated connector comprises a first arm and a second arm aligned substantially parallel to one another and substantially perpendicular to the first shaft and the second articulated connector comprises a first arm and a second arm aligned substantially parallel to one another and substantially perpendicular to the second shaft.

11. The umbrella or parasol system of claim 10, wherein:

a first end of the first arm of the first articulated connector is operatively connected to a first end of the grip and a second end of the first arm of the first articulated connector is operatively connected to the first end of the first shaft;

a first end of the second arm of the first articulated connector is operatively connected to a second end of the grip and a second end of the second arm of the articulated connector is operatively connected to the first shaft at a location away from the first end of the first shaft;

a first end of the first arm of the second articulated connector is operatively connected to a first end of the grip and a second end of the first arm of the second articulated connector is operatively connected to the first end of the second shaft; and a first end of the second arm of the second articulated connector is operatively connected to a second end of the grip and a second end of the second arm of the second articulated connector is operatively connected to the second shaft at a location away from the first end of the second shaft.

12. The umbrella or parasol system of claim 8, wherein when the system is in a closed position:

the first runner is located proximate the second end of the first shaft and the second runner is located proximate the second end of the second shaft;

the first shaft is parallel to the second shaft; and the first articulated connector and the second articulated connector are located below the grip.

13. The umbrella or parasol system of claim 8, wherein the distance between the first shaft and the second shaft increases when the system is transitioned from a closed position to an open position.

* * * * *